US011668032B2

(12) United States Patent
Weis et al.

(10) Patent No.: US 11,668,032 B2
(45) Date of Patent: Jun. 6, 2023

(54) NONWOVEN WITH AN EMBOSSED MESH PATTERN

(71) Applicant: Carl Freudenberg KG, Weinheim (DE)

(72) Inventors: Norbert Weis, Weinheim (DE); Christoph Rieger, Schriesheim (DE); Klaus Schwoebel, Schriesheim (DE); Dieter Philipp, Schriesheim (DE)

(73) Assignee: CARL FREUDENBERG KG, Weinheim (DE)

( * ) Notice: Subject to any disclaimer, the term of this patent is extended or adjusted under 35 U.S.C. 154(b) by 1092 days.

(21) Appl. No.: 16/075,669

(22) PCT Filed: Dec. 21, 2016

(86) PCT No.: PCT/EP2016/082087
§ 371 (c)(1),
(2) Date: Aug. 6, 2018

(87) PCT Pub. No.: WO2017/140403
PCT Pub. Date: Aug. 24, 2017

(65) Prior Publication Data

US 2021/0189619 A1 Jun. 24, 2021

(30) Foreign Application Priority Data

Feb. 17, 2016 (DE) ..... 10 2016 001 807.0

(51) Int. Cl.
*D04H 1/541* (2012.01)
*D04H 1/485* (2012.01)
*D06C 23/04* (2006.01)

(52) U.S. Cl.
CPC ..... *D04H 1/5418* (2020.05); *D04H 1/485* (2013.01); *D06C 23/04* (2013.01); *D06C 2700/31* (2013.01)

(58) Field of Classification Search
CPC .... D01H 1/485; D06C 23/04; D06C 2700/31; D04H 1/485; D04H 1/54
See application file for complete search history.

(56) References Cited

U.S. PATENT DOCUMENTS 4,678,703 A 7/1987 Shibasaki et al.
2002/0106478 A1 8/2002 Hayase et al.
(Continued)

FOREIGN PATENT DOCUMENTS

CN 101790604 A 7/2010
DE 2934009 A1 3/1980
(Continued)

OTHER PUBLICATIONS

English Machine Translation of JP2005245913, IP.com, retrieved Apr. 12, 2021.*
(Continued)

*Primary Examiner* — Jennifer A Gillett
(74) *Attorney, Agent, or Firm* — Leydig, Voit & Mayer, Ltd.

(57) ABSTRACT

A nonwoven includes: framework fibers; an at least in part fused thermoplastic material; and a thermally embossed mesh pattern having a plurality of intersecting embossed grooves, between which a plurality of embossed elevations are arranged. At least the framework fibers are staple fibers. An equivalent diameter of the embossed elevations is smaller than 50% of a fiber length of the framework fibers. A ratio of a width of the embossed grooves to a thickness of the nonwoven in a region of the embossed elevations is less than or equal to 4/5 A ratio of the width of the embossed grooves to a thickness of the nonwoven in a region of the embossed grooves is from 0.5 to 2.

16 Claims, 6 Drawing Sheets

(56) References Cited

U.S. PATENT DOCUMENTS

| | | | | |
|---|---|---|---|---|
| 2003/0045196 | A1* | 3/2003 | Kumehara | D04H 3/16 442/364 |
| 2003/0176132 | A1* | 9/2003 | Moriyasu | B08B 1/006 442/361 |
| 2004/0142151 | A1 | 7/2004 | Toyoshima et al. | |
| 2010/0191207 | A1 | 7/2010 | Oba | |
| 2012/0315440 | A1 | 12/2012 | Ichikawa et al. | |
| 2015/0297053 | A1* | 10/2015 | Hayase | A47L 13/17 15/104.93 |
| 2016/0362825 | A1* | 12/2016 | Novarino | D04H 1/559 |

FOREIGN PATENT DOCUMENTS

| | | | | |
|---|---|---|---|---|
| DE | 60309268 | T2 | 2/2007 | |
| EP | 0863240 | A1 | 9/1998 | |
| EP | 1342825 | A1 | 9/2003 | |
| EP | 1322806 | B1 | 9/2005 | |
| EP | 2058116 | A3 | 3/2012 | |
| EP | 2821043 | A1 | 1/2015 | |
| GB | 2031039 | A * | 4/1980 | A47L 13/16 |
| GB | 2031039 | A | 4/1980 | |
| JP | 60194160 | A | 10/1985 | |
| JP | 2002249965 | A | 9/2002 | |
| JP | 2005245913 | A | 9/2005 | |

OTHER PUBLICATIONS

English Machine Translation of JP2002249965, IP.com, retrieved Apr. 13, 2021.*

English Machine Translation of JP 2002-249965, retrieved from IP.com Feb. 3, 2022.*

English Machine Translation of JP 2005-245913, retrieved from IP.com Feb. 3, 2022.*

* cited by examiner

NONWOVEN WITH AN EMBOSSED MESH PATTERN

CROSS-REFERENCE TO PRIOR APPLICATIONS

This application is a U.S. National Phase application under 35 U.S.C. § 371 of International Application No. PCT/EP2016/082087, filed on Dec. 21, 2016, and claims benefit to German Patent Application No. DE 10 2016 001 807.0, filed on Feb. 17, 2016. The International Application was published in German on Aug. 24, 2017 as WO 2017/140403 under PCT Article 21(2).

FIELD

The invention relates to a nonwoven having an embossed mesh pattern. The invention further relates to a method for producing a nonwoven of this kind and to the use thereof as a wipe for households, the commercial sector and/or as a wiping material in a mop.

BACKGROUND

Textile fabrics in the form of nonwovens are widely used as wipes and as a wiping material in mops. In order to achieve higher durability, the fibers in nonwovens of this kind are generally either thermally bonded by fusing thermoplastic fibers that are present or by adhesively bonding and/or enmeshing the fibers by means of chemical binder systems that are applied or introduced.

In order to further increase the bonding and improve the mechanical properties, thermal compression by means of heated rollers is described, for example, in JP 60-194160. The result of this all-over compression, however, is thin, paper-like fabrics that are not very flexible or absorbent.

As is described in EP 1 322 806 B1, moist baby wipes can also be provided in part with embossing in order to increase the strength of the material; however, this leads to an increase in the bending moment and thus to undesirable stiffness of the wipes in the known methods and patterns. In order to still obtain moist disposable wipes that meet the requirements of softness, volume, absorption and mechanical strength, the cited document proposes setting a distance of at least half of the nominal fiber length between discrete (individual, non-linked) embossed regions. The embossed region is also intended to be between 4% and 8% of the total surface area.

According to the described prior art, flexibility and strength are counteracting properties of thermally compressed (calendered) nonwovens. For use as reusable wipes or as a wiping material in mops, the compromises in the softness and strength to be achieved according to the prior art by embossing are not acceptable, and they have therefore not yet gained recognition, unlike in the field of moist disposable wipes.

In the light of this, the object of the invention is to provide a nonwoven which satisfies strict requirements for softness, flexibility and durability at the same time. The nonwoven is also intended to be distinguished by adequate absorption properties and in particular to allow wipes and wiping materials in mops having the above-mentioned properties to be produced.

SUMMARY

In an embodiment, the present invention provides a nonwoven, comprising: framework fibers; an at least in part fused thermoplastic material; and a thermally embossed mesh pattern comprising a plurality of intersecting embossed grooves, between which a plurality of embossed elevations are arranged, wherein at least the framework fibers comprise staple fibers, wherein an equivalent diameter of the embossed elevations is smaller than 50% of a fiber length of the framework fibers, wherein a ratio of a width of the embossed grooves to a thickness of the nonwoven in a region of the embossed elevations is less than or equal to 4/5, and wherein a ratio of the width of the embossed grooves to a thickness of the nonwoven in a region of the embossed grooves is from 0.5 to 2.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
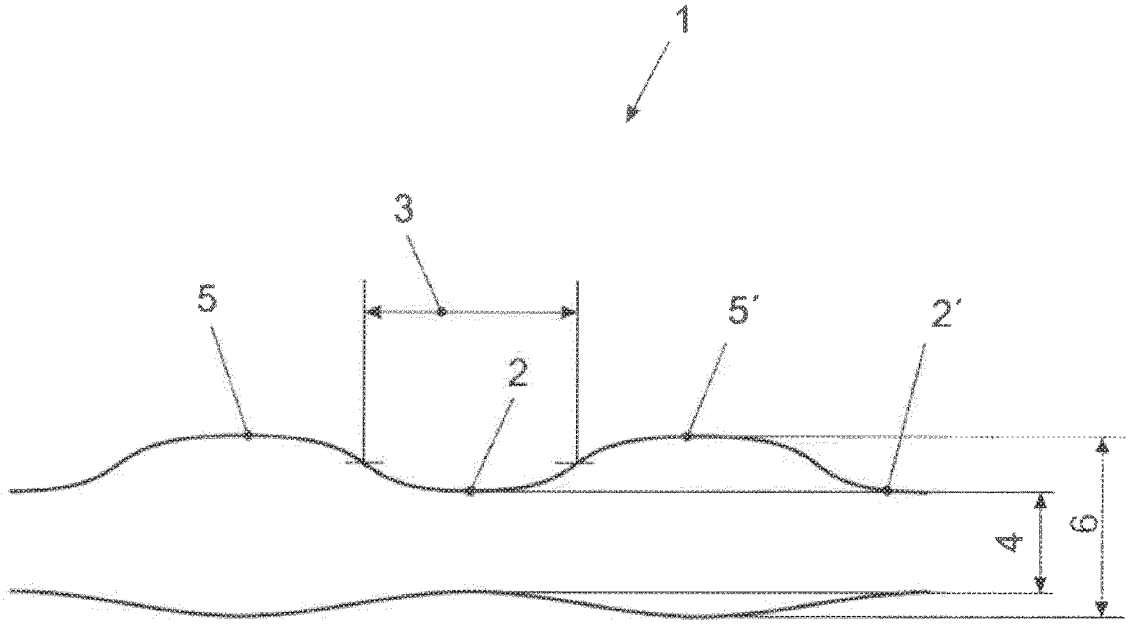
FIG. 1 is a schematic view of a detail from the cross section of a nonwoven according to the invention.

It has been recognized that, if the embossed grooves are arranged and dimensioned in a specific manner in relation to the fiber length, it is possible to increase both the durability of a nonwoven and the softness and flexibility thereof, without significantly reducing the absorbency of the nonwoven on account of the embossed grooves that are applied.

The present invention relates to a nonwoven, comprising framework fibers and an at least in part fused thermoplastic material, in particular at least in part fused thermoplastic binding fibers, at least the framework fibers being staple fibers, the nonwoven having a thermally embossed mesh pattern consisting of a plurality of intersecting embossed grooves, between which a plurality of embossed elevations are arranged, wherein the equivalent diameter of the embossed elevations is smaller than 50% of the fiber length of the framework fibers, wherein the ratio of the width of the embossed grooves to the thickness of the nonwoven in the region of the embossed elevations is less than or equal to 4/5, and wherein the ratio of the width of the embossed grooves to the thickness of the nonwoven in the region of the embossed grooves is from 0.5 to 2.

An essential aspect of the nonwoven according to the invention is the presence of a thermally embossed mesh pattern consisting of a plurality of intersecting embossed grooves. In this mesh pattern, a plurality of embossed elevations are arranged between the embossed grooves. In the region of the embossed grooves, the nonwoven is compressed in comparison to the embossed elevations, and the thermoplastic material is at least in part fused, as a result of which the embossed structure is stabilized. The mesh pattern also has a positive effect on the stability and durability of the nonwoven as a whole. The pattern may be formed over the entire surface area or only over regions of the nonwoven. In a preferred embodiment of the invention, the mesh pattern is formed over at least 60%, preferably from 70% to 100% and in particular from 80% to 100% of the surface area of the nonwoven.

A further essential aspect of the nonwoven according to the invention is that the embossed grooves are arranged and dimensioned such that the equivalent diameter of the embossed elevations is smaller than 50% of the fiber length of the framework fibers.

The term "equivalent diameter of the embossed elevations" as used herein means the diameter of the smallest circle that which circumscribes the entire embossed elevation (i.e. that can be drawn around and/or enclose said elevation). If the symbol circumscribes, this means that at least two points of the embossed elevation touch the circle tangentially and no portion of the embossed elevation externally intersects the circle. Of course, no circle has to be actually drawn or marked on the nonwoven in order for said elevation to be circumscribed. For the purposes of the present invention, equivalent symbol diameters were determined as shown below in the section on the test methods.

A further essential aspect of the nonwoven according to the invention is that the ratio of the width of the embossed grooves to the thickness of the nonwoven in the region of the embossed elevations is less than or equal to 4/5, and the ratio of the width of the embossed grooves to the thickness of the nonwoven in the region of the embossed grooves is from 0.5 to 2.

The width of the embossed grooves is defined as the distance between two points of inflection W, at which an embossed groove transitions into the adjacent embossed elevations. For the purposes of the present invention, the width of the embossed grooves was determined as described below in the section on the test methods. Furthermore, the thickness of the nonwoven in the region of the embossed elevations was measured according to DIN EN ISO 9073-2:1997, and the thickness of the nonwoven in the region of the embossed grooves was measured as shown below in the section on the test methods.

It has been found that, if the embossed grooves are arranged and dimensioned in this specific manner in coordination with the fiber length of the framework fibers, it is possible to achieve a very good property profile of high strength, wear resistance, absorbency and flexibility of the nonwoven, and this is advantageous for the use as a wipe and/or a wiping material in a mop.

In particular, the specific arrangement and dimensioning of the embossed grooves in relation to the fiber length allows a high proportion of framework fibers that are interlaced at more than one point, for example at two points, i.e. framework fibers that are interlaced at at least two different points in the compressed region of the embossed grooves. It is thus possible to improve the durability and strength of the nonwoven and to achieve low fiber loss when the nonwoven is used and washed. Furthermore, the nonwoven according to the invention is surprisingly characterized by high flexibility, or more precisely a low bending moment, and this allows the nonwoven to readily conform to shapes and thus makes it pleasant to the touch. Furthermore, the specific mesh pattern gives the nonwoven strong cleaning performance, even against coarser particles of dirt.

While it is not intended to rely on the theory alone, it is understood that, while, if the embossed grooves and fiber lengths are arranged and dimensioned according to the invention, the individual framework fibers are rigidly interconnected in a three-dimensional structure by means of the thermoplastic material in the embossed grooves, and are thus restricted in terms of their position and ability to move in relation to one another, the embossed grooves are still far enough apart from another that the embossed regions can effectively act as joints and the flexibility of the nonwoven is thus increased.

As a result of this effect, the usual tendency for an embossing process to dramatically increase the bending moment of the materials is overcompensated. However, high resistance, strength and dimensional stability are achieved during use and washing, on account of the strong connection of the framework fibers.

In practical experiments, it has been found to be particularly advantageous for the equivalent diameter of the embossed elevations to be from 5% to 50%, preferably from 5% to 40%, more preferably from 7% to 40% and in particular from 8% to 30% of the fiber length of the framework fibers.

It has also been found to be particularly advantageous for the ratio of the width of the embossed grooves to the thickness of the nonwoven in the region of the embossed elevations to be from 4/5 to 1/5, preferably from 4/5 to 1/3 and in particular from 2/3 to 1/3.

It has been found to be also particularly advantageous for the ratio of the width of the embossed grooves to the thickness of the nonwoven in the region of the embossed grooves to be from 0.5 to 1.5 and in particular from 0.75 to 1.25.

The proportion of the surface area of the embossed elevations over the total surface area of the nonwoven can be set on the basis of the desired properties of the nonwoven. In principle, it is possible to increase the fluffiness and absorbency of the nonwoven by increasing the proportion of the surface area of the embossed elevations over the total surface area of the nonwoven. In the light of this, it has been found to be advantageous to set the total surface area of the embossed elevations to more than 50%, preferably from 55% to 85%, more preferably from 60% to 80%, based on the total surface area of the nonwoven. If the mesh pattern is present only over regions of the nonwoven, only the region provided with the mesh pattern is thus considered to be the total surface area of the nonwoven when determining the proportion of the surface area of the embossed elevations.

In this case, the proportion of the surface area of the embossed elevations over the total surface area of the nonwoven can be determined by coloring the embossed elevations and then carrying out a visual assessment, as is shown below in the section on the test methods.

It is in turn possible to increase the resistance, strength and dimensional stability of the nonwoven by increasing the proportion of the surface area of the embossed grooves over the total surface area of the nonwoven. In the light of this, the proportion of the surface area of the embossed grooves over the total surface area of the nonwoven is preferably more than 15%, for example from 15% to 45%, more preferably from 20% to 40%. If the mesh pattern is present only over regions of the nonwoven, only the region provided with the mesh pattern is thus considered to be the total surface area of the nonwoven when for determining the proportion of the surface area of the embossed grooves.

The proportion of the surface area of the embossed grooves over the total surface area of the nonwoven can also be determined by coloring the embossed elevations and carrying out a visual assessment, as is shown below in the section on the test methods.

According to the invention, the nonwoven contains an at least in part fused thermoplastic material, in particular thermoplastic binding fibers. This allows the framework fibers in the nonwoven to be consolidated. The thermoplastic material may comprise thermoplastic binding particles, in particular binding powders, and/or binding fibers. According to the invention, binding fibers are preferred as they are particularly easy to process and can be distributed uniformly in the nonwoven.

In order to allow the thermoplastic material to melt readily when the nonwoven is produced, the melting point of the thermoplastic material is advantageously at least 30° C., for example from 30° C. to 150° C., more preferably at least 40° C., for example from 40° C. to 150° C. and in particular at least 45° C., for example from 45° C. to 130° C. below the melting point or decomposition point of the framework fibers.

As is explained above, the at least in part fused thermoplastic material makes it possible to achieve stabilization of the embossed mesh pattern and the nonwoven as a whole. Said material can be melted in a simple manner when the nonwoven is produced, for example by using heated embossing rollers.

At least in part fused thermoplastic materials that are particularly preferred according to the invention contain polyolefin, in particular polypropylene and/or polyethylene, and polyester, polyamide, polylactide, and/or mixtures and copolymers thereof.

In order to achieve sufficient stabilization of the mesh pattern and the nonwoven as a whole, it has been found to be expedient to set the proportion of the at least in part fused thermoplastic material to at least 5 wt. %, preferably from 5 wt. % to 30 wt. %, more preferably from 15 wt. % to 25 wt. %, based on the total weight of the nonwoven. Setting said proportion to more than 30% is not advantageous as this restricts the flexibility of the nonwoven in an undesirable manner.

The nonwoven contains framework fibers as a further component. As is appropriate for their function as framework fibers, said fibers are preferably not fused or are at least fused to a significantly lesser degree than the at least in part fused thermoplastic material. In a preferred embodiment of the invention, the framework fibers are selected from non-thermoplastic materials, for example natural fibers, preferably cellulose fibers, in particular viscose or cotton fibers and/or mixtures thereof.

The use of thermoplastic fibers as framework fibers is also conceivable, however, provided that the melting point thereof is sufficiently far away from the melting point of the at least in part fused thermoplastic material. In particular, polyester, polyamide and polylactide fibers and/or mixtures thereof are suitable for this purpose.

According to the invention, the use of mixtures of non-thermoplastic and thermoplastic fibers as framework fibers is particularly preferred, since this allows a particularly good property profile to be achieved for use as a wipe and/or wiping material in a mop.

According to the invention, the framework fibers are staple fibers. In contrast with filaments, which at least theoretically have an unlimited length, staple fibers have defined lengths. The average length of the framework fibers is preferably from 15 mm to 85 mm, more preferably from 20 mm to 60 mm, in particular from 25 mm to 55 mm. It has been found that, by combining the above-mentioned fiber lengths and the specific mesh pattern, it is possible to achieve double fiber interlacing and to still ensure a sufficiently unbonded fiber surface and free fiber ends so as to achieve strong cleaning performance of the nonwoven.

The average titer of the framework fibers is preferably between 0.1 dtex and 2.6 dtex, more preferably from 0.3 dtex to 2.4 dtex, in particular from 0.6 dtex to 2.2 dtex. If a mixture of fibers of different titers is present, fiber titers greater than 6.7 dtex are not taken into account when determining the average titer. It has been found that fibers having the above-mentioned fiber titers allow both strong cleaning performance and pleasantness to the touch.

The weight per unit area of the nonwoven is preferably in the range of between 50 g/m$^2$ and 300 g/m$^2$, more preferably from 100 g/m$^2$ to 250 g/m$^2$, in particular from 120 g/m$^2$ to 220 g/m$^2$. It has been found that, in the case of the above-mentioned weights per unit area, it is possible to achieve both high absorbency and pleasing, agreeable flexibility of the nonwoven on account of sufficient available volume.

The volume weight of the region of the nonwoven that is compressed by the embossed grooves can be calculated from the thickness of the nonwoven in the region of the embossed grooves and from the weight per unit area of the nonwoven, and is preferably less than 0.0005 g/mm$^3$, more preferably from 0.00015 g/mm$^3$ to 0.00045 g/mm$^3$.

In the region of the embossed elevations, the nonwoven has a lower density than in the region of the embossed grooves, and is therefore more voluminous and absorbent than in the region of the embossed grooves.

The volume weight of the region of the nonwoven that is not compressed by the embossed grooves can be calculated from the thickness of the nonwoven in the region of the embossed elevations and from the weight per unit area of the nonwoven, and is preferably less than 0.00015 g/mm$^3$, more preferably from 0.00008 g/mm$^3$ to 0.00012 g/mm$^3$.

As is explained above, the nonwoven according to the invention surprisingly has a low bending moment, at least in one direction. Said bending moment is preferably lower than the bending moment of a nonwoven of the same composition but without embossed grooves.

In at least one direction, the bending moment of a nonwoven according to the invention is preferably less than 90%, more preferably between 70% and 90%, in particular between 75% and 85% of a nonwoven of the same composition but without embossing.

As is explained above, the nonwoven can be thermally consolidated by means of the at least in part fused thermoplastic material. The in part fused thermoplastic material is present here at least in the regions of the embossed grooves. In a preferred embodiment, the at least in part fused thermoplastic material is additionally also present in the regions of the embossed elevations, which allows the nonwoven to be further stabilized. The at least in part fused regions can be formed, as is explained above, by means of the embossing process. It may also be advantageous, however, to carry out additional thermal consolidation, in which the thermoplastic material at least in part fuses.

In addition to the thermal consolidation, the nonwoven may also comprise a binder agent for the consolidation, at least some of the fibers advantageously being bonded by means of a binder. Any binder that is common for chemically consolidating textile materials can be used here, the binder preferably being selected from the group consisting of an aqueous copolymer dispersion of vinyl acetate and ethylene.

It is also conceivable for the nonwoven to be additionally also consolidated by needle-punching.

The shape of the embossed grooves may be linear or non-linear, for example in the form of waves or zigzags, as long as a mesh pattern is formed as a result.

It is also conceivable for the embossed grooves to be discontinuous and form, for example, dashed and/or dotted grooves. This can have an advantageous effect on the absorbency of the nonwoven.

In an advantageous embodiment of the invention, the mesh pattern is designed as a diamond pattern, honeycomb pattern, fish scale pattern, waffle pattern, linen pattern and/or butterfly pattern.

According to the invention, the fish scale pattern shown in FIGS. 2 and 4 to 6 by way of example is preferred. The mesh pattern is preferably oriented such that the embossed grooves extend diagonally to the direction of travel of the machine. As a result, uniformity of the strength values (measured as maximum tensile force) in the longitudinal and transverse directions can be achieved.

The specific embodiment of the nonwoven according to the invention allows a uniform property profile. The MD/CD ratio of the maximum tensile force is thus preferably more than 0.65, for example from 0.65 to 0.95, more preferably from 0.75 to 0.95. In these ratios, the nonwoven according to the invention demonstrates a uniform strength profile, and this is found to be advantageous for the use of said nonwoven.

The nonwoven may have a structure having one or more layers. Said nonwoven preferably has a single-layer structure. The embossed mesh pattern can thus be formed in a single process step on the two sides of the nonwoven. Delamination is also made more difficult.

The nonwoven according to the invention is highly suitable as a wipe for households and/or the commercial sector and/or as a wiping material in a mop.

The nonwoven according to the invention can be produced, for example, by means of a method comprising the following method steps:

- providing a fibrous web comprising staple fibers as framework fibers, and a thermoplastic material, in particular thermoplastic binding fibers;
- consolidating the fibrous web by means of needle-punching, binder and/or the application of heat;
- thermally embossing a mesh pattern while at least in part fusing the thermoplastic material, wherein the mesh pattern
  - has a plurality of intersecting embossed grooves, between which a plurality of embossed elevations are arranged,
  - the equivalent diameter of the embossed elevations is smaller than 50% of the fiber length of the framework fibers,
  - the ratio of the width of the embossed grooves to the thickness of the nonwoven in the region of the embossed elevations is less than or equal to 4/5,
  - the ratio of the width of the embossed grooves to the thickness of the nonwoven in the region of the embossed grooves is from 0.5 to 2.

The thermal embossing can be carried out in a simple manner by using heated embossing rollers, for example.

According to the invention, the consolidation preferably takes place at least by means of needle-punching and optionally additionally by means of binder and/or the application of heat, for example by means of a calender or an oven.

During the needle-punching process, it is advantageous that said process can cause the fibers in the nonwoven to be reoriented, and thus allows the property profile of the nonwoven to further adjusted.

In this process, the specific mesh pattern can be obtained by suitably selecting the embossing ribs on the embossing rollers.

FIG. 1 is a schematic view of a detail from the cross section of a nonwoven 1 according to the invention having an embossed groove 2, which has a width 3. In the region of the embossed groove 2, the nonwoven 1 has a thickness 4. Two embossed elevations 5 and 5' adjoin the embossed groove 2 to the left and right. In the region of each of the embossed elevations 5 and 5', the nonwoven 1 has a thickness 6.

Figure 2:
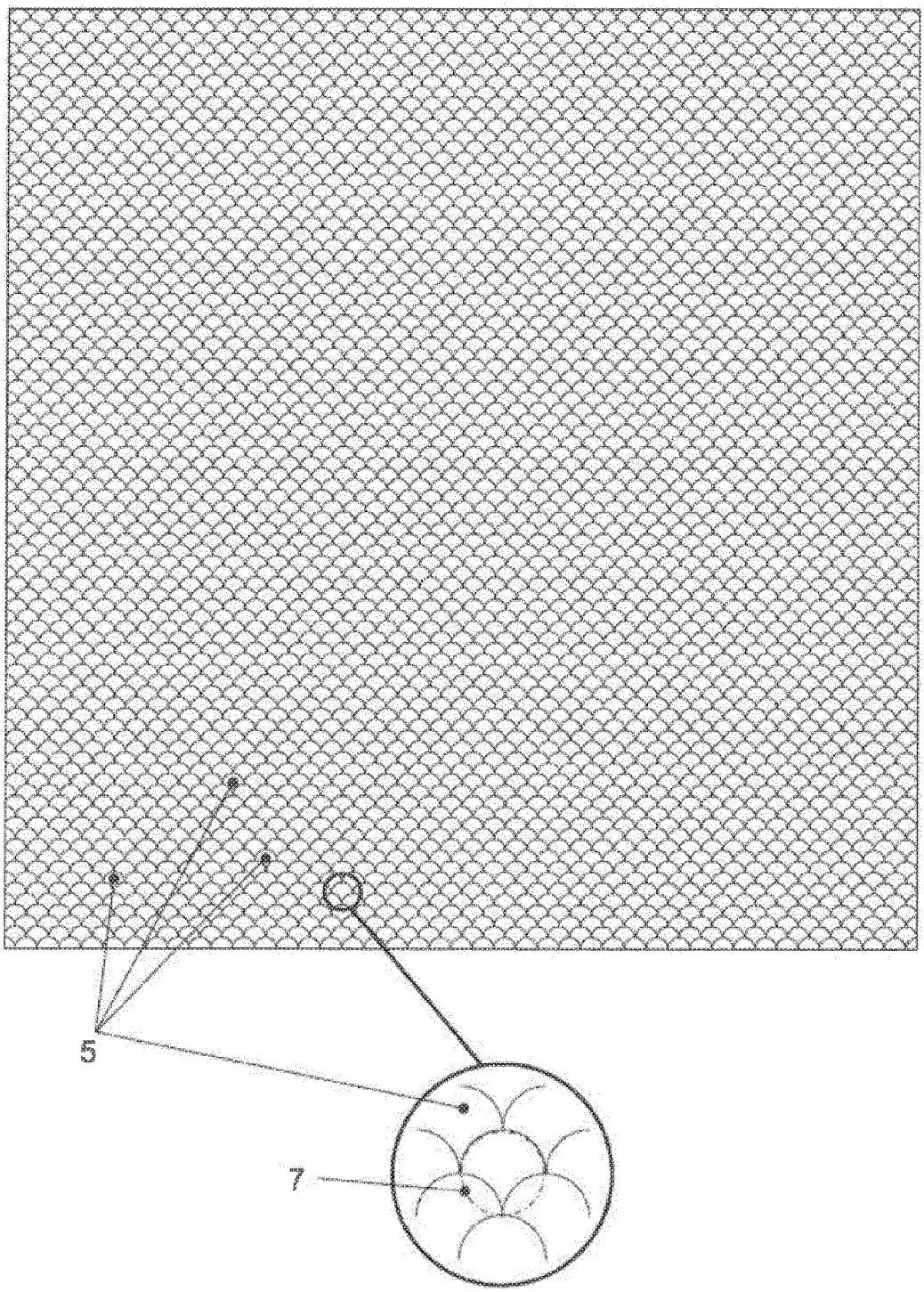
FIG. 2 is a schematic plan view of a nonwoven according to the invention, and an enlarged view of a detail thereof.

FIG. 2 is a schematic plan view of a nonwoven 1 according to the invention comprising a plurality of embossed elevations 5. By way of example, the smallest circle that circumscribes the entire embossed elevation 5 is shown on one embossed elevation 5. The diameter of this circle is the equivalent diameter 7 of said embossed elevation 5.

Figure 3:
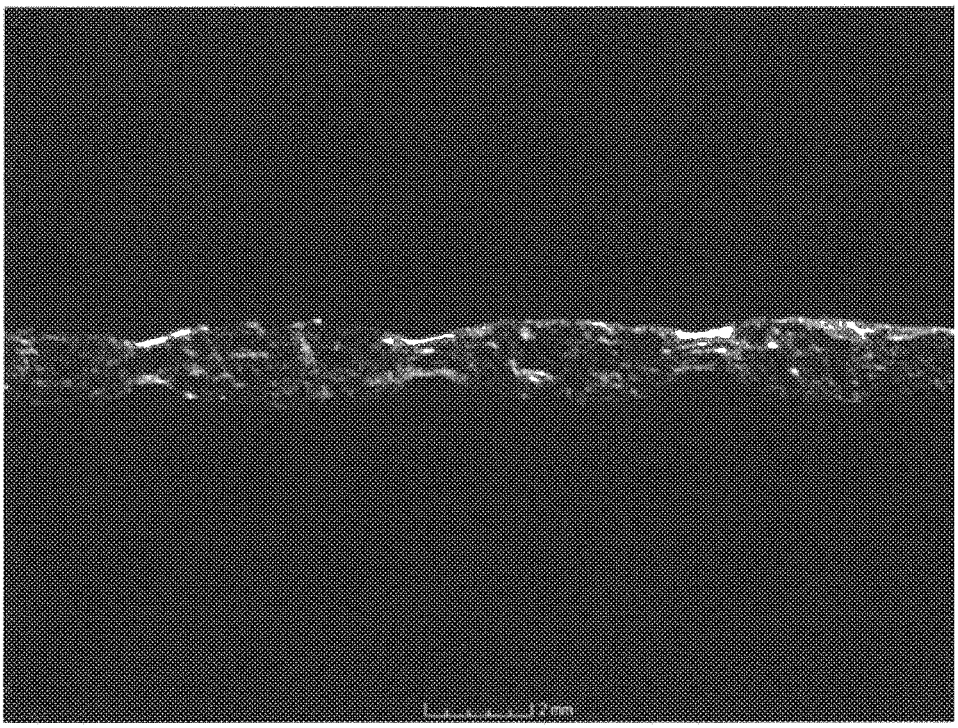
FIG. 3 is a CT scan of a detail from the cross section of a nonwoven according to the invention.

FIG. 3 is a CT scan of a detail from the cross section of a nonwoven 1 according to the invention.

Figure 4:
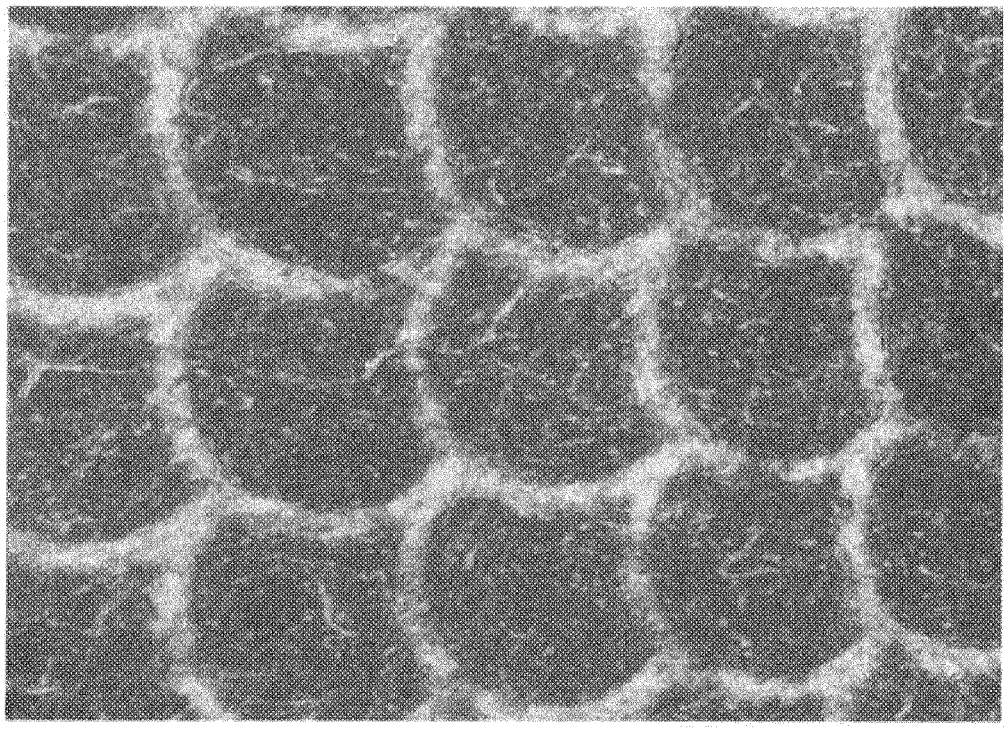
FIG. 4 is a CT scan of a detail from the plan view of a nonwoven according to the invention.

FIG. 4 is a CT scan of a detail from the plan view of a nonwoven 1 according to the invention.

Figure 5:
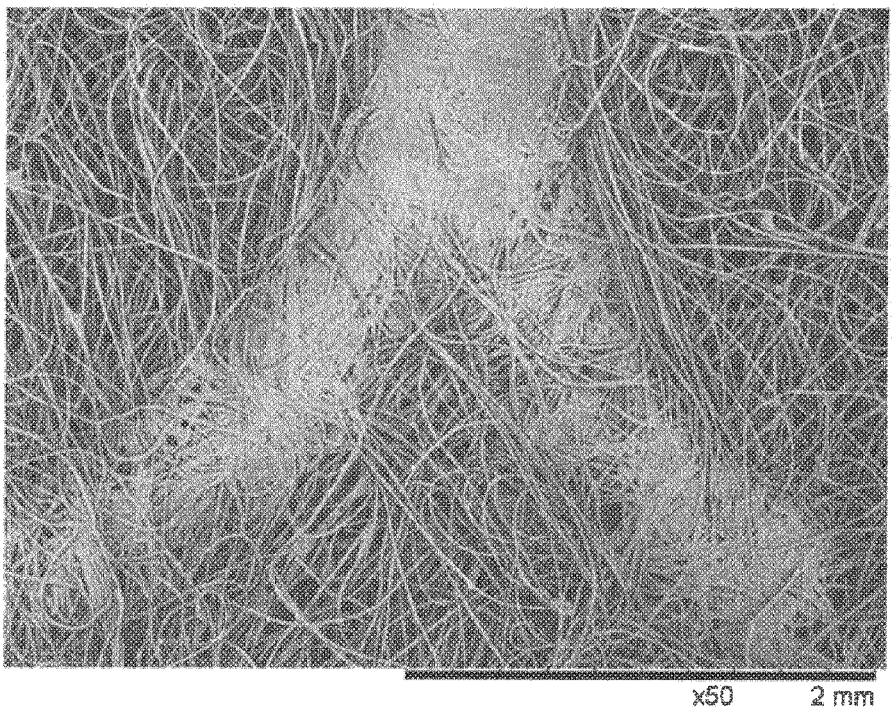
FIG. 5 is an REM image of a detail from the plan view of a nonwoven according to the invention.

FIG. 5 is a REM image, magnified 50 times, of a detail from the plan view of a nonwoven 1 according to the invention.

Figure 6:
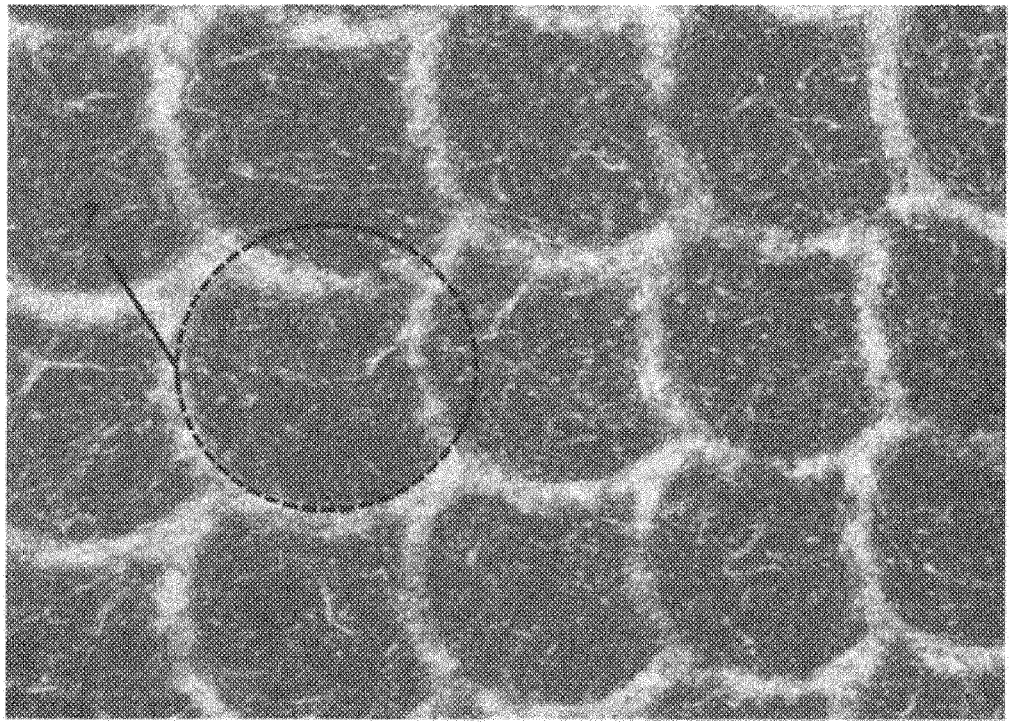
FIG. 6 is a further CT scan of a detail from the plan view of a nonwoven according to the invention.

FIG. 6 is a further CT scan of a detail from the plan view of a nonwoven 1 according to the invention. By way of example, the smallest circle that circumscribes the entire embossed elevation 5 is shown on one embossed elevation 5. The diameter of this circle is the equivalent diameter 7 of said embossed elevation 5.

Test Methods

When selecting the regions used for the test methods, care must always be taken to ensure that representative details having the predominant pattern are selected.

Equivalent Diameter of the Embossed Elevations

The equivalent diameter of the embossed elevations is determined as follows: A computer-tomographic image of the plan view of the nonwoven having the entire repeating pattern unit is used as a basis.

In the assessment (in the present case by means of Volume Graphics VG Studio Max), a circular template is used for the embossed elevations in the mesh pattern in order to measure the diameter of the smallest circle that can circumscribe the entire embossed elevation (i.e. that can be drawn around and enclose said elevation) (as is described above with reference to the definition of the equivalent diameter of the embossed elevations). The measurement should be accurate to within +/−0.6 mm. The diameter of the circumscribing circle is the equivalent diameter of the embossed elevations.

After the equivalent diameters of the embossed elevations in the mesh pattern have been determined, the numerical value of the diameters is taken as an average value of at least five individual measurements.

In this process, any very small embossed elevations, i.e. embossed elevations having an equivalent diameter of less than 5% of the fiber length, are not taken into account.

Thickness of the Nonwoven in the Region of the Embossed Grooves and Width of the Embossed Grooves A computer-tomographic image of the nonwoven in cross section is used to determine the thickness of the nonwoven in the region of the embossed grooves.

The thinnest points of at least five embossed grooves are visually determined (in the present case by means of Volume Graphics VG Studio Max), and the average value is calculated. As a result, the thickness of the nonwoven in the region of the embossed grooves is obtained.

In order to determine the width of the embossed grooves, the thickness of the nonwoven is first determined. Said thickness corresponds to the thickness of the nonwoven in the region of the embossed elevations.

The arithmetic mean is then calculated from the thickness of the nonwoven in the region of the embossed grooves and the thickness of the nonwoven in the region of the embossed elevations. The resultant value corresponds to the thickness of the nonwoven in the region of the points of inflection W, which points can then be visually drawn on the computer-tomographic image. If the shortest distance between two points of inflection W defining the same groove is measured, the width of said embossed groove is obtained. This measurement is repeated for at least five embossed grooves, and the average value is calculated.

Determining the Proportion of Embossed Elevations and Embossed Grooves Over the Total Surface Area In order to determine the proportion of embossed elevations over the total surface area of the nonwoven, said nonwoven is laid flat and adhesively bonded to a metal plate that has the same dimensions (8×4 cm) and a total weight of 114 g±10 g and is moved over a commercially available stamp pad in a circling manner (ten times clockwise and ten times counter-clockwise) without additional pressure. As a result, the embossed elevations are colored. This sample can subsequently be scanned or photographed and analyzed by means of image processing software (in the present case by means of Adobe Photoshop). For this purpose, the proportion of embossed elevations over the total surface area can be determined, on the basis of the pixels, from the color difference between the colored areas and the non-colored area. The determination takes place at least three times.

The difference measurement from the total surface area and the proportionate area of the embossed elevations results in the proportion of the area of the embossed grooves over the total surface area of the nonwoven.

Thickness of the Nonwoven

In accordance with test specification DIN EN ISO 9073-2:1997, the thickness of the nonwoven is measured using a precision thickness gauge having a 25 $cm^2$ feeler area and 0.5 kPa pressure. At least ten points on the sample are measured, and the average value is subsequently calculated.

Weight Per Unit Area

Based on test specification DIN EN ISO 9073-1:1989, in order to determine the weight per unit area, at least ten samples having a sample size of 100 mm×100 mm are stamped out, these samples are weighed, and the measured values are multiplied by 100. The average value is calculated from these individual values.

Length of the Staple Fibers

The individual fiber length measurement is carried out, depending on the fiber type, by means of the one-tweezer or two-tweezer method in accordance with DIN 53808-1:03. In contrast with the test standard, the number of measurements is n=50.

Care must be taken to ensure that the fibers are not shortened when removed from the nonwoven. This applies especially to thermally consolidated and embossed nonwovens.

Determining the Melting Point

The melting point of the thermoplastic material is determined according to test specification DIN EN ISO 11357-3:2013.

Determining Tensile Strength

The maximum tensile strength is determined according to test specification DIN EN ISO 9073-3:1992.

Determining the Bending Length

The bending length is determined in accordance with test specification DIN EN ISO 9073-7:1998. The sample size is 250×50 mm. Three individual measurements are carried out, and the average value in mm is calculated. The smaller the bending length, the lower the bending stiffness.

The invention will be explained below in more detail on the basis of an example.

EXAMPLE

In the case of a nonwoven according to the invention that is given by way of example, the production is carried out in the dry laying method. In this embodiment, a fiber mixture consisting of 50% viscose fibers (1.7 dtex, 50 mm), 30% polyester fibers (0.9 dtex, 38 mm) and 20% polypropylene hotmelt-adhesive fibers (2.2 dtex, 40 mm) is mixed so as to be homogeneous and laid by means of a carding machine to form a web. After the web layers have been doubled, consolidation takes place by means of needle-punching before this nonwoven is additionally thermoset in an oven. The nonwoven is also stretched in-between. The subsequent embossing process embosses a mesh pattern having the appearance of fish scales into the nonwoven. In addition, a design print can be applied to the nonwoven before or after the embossing unit.

The nonwoven according to the invention has a weight per unit area of 145 $g/m^2$, the thickness in the region of the embossed elevations is 1.4 mm, and the thickness in the region of the embossed grooves is 0.7 mm. The equivalent diameter of a mesh pattern unit is 6.5 mm. This leads to the fibers being thermally interlaced at at least two points on average. Furthermore, the ratio of the width of the embossed grooves to the thickness of the nonwoven in the region of the embossed elevations is 1/2, and this has a positive effect on the bending stiffness of the nonwoven, in the same way as the ratio of the width of the embossed grooves to the thickness of the nonwoven in the region of the embossed grooves, which ratio assumes a value of 1 in this advantageous embodiment.

In order to measure and calculate the dimensions of the embossed elevations and embossed grooves, a computer-tomographic 3D model of the nonwoven was generated. The determination of the thickness of the nonwoven in the region of the embossed elevations and the measurement of the weight per unit area of the nonwoven and the strength and bending stiffness thereof were carried out according to the above-mentioned test specifications.

The specific embodiment of the mesh pattern in which 30% of the total surface area is covered (measured by coloring the raised regions and by means of software-assisted, pixel-based analysis) leads to uniformity of the tensile strengths in the longitudinal and transverse directions and to a reduction in the bending length in at least one direction (measured in accordance with test specification DIN EN ISO 9073-7:1998) to less than 10 mm of the nonwoven.

By applying the specific mesh pattern, the nonwoven is more stable and more flexible at the same time and is therefore highly suitable as a wipe and/or wiping material in mops.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A nonwoven, comprising:

framework fibers;

an at least in part fused thermoplastic material; and a thermally embossed mesh pattern comprising a plurality of intersecting embossed grooves, between which a plurality of embossed elevations are arranged, wherein the framework fibers are staple fibers having an average length from 15-85 mm, wherein the framework fibers are not fused, wherein an equivalent diameter of the embossed elevations is smaller than 50% of a fiber length of the framework fibers, wherein a ratio of a width of the embossed grooves to a thickness of the nonwoven in a region of the embossed elevations is less than or equal to 4/5, wherein a ratio of the width of the embossed grooves to a thickness of the nonwoven in a region of the embossed grooves is from 0.5 to 2, and wherein the at least in part fused thermoplastic material is present in an amount from 5 wt. % to 25 wt. %, based on total weight of the nonwoven.

2. The nonwoven according to claim 1, wherein surface area of the embossed grooves over a total surface area of the nonwoven comprises more than 15% of a total surface area of the nonwoven.

3. The nonwoven according to claim 1, wherein the framework fibers have a titer of between 0.1 dtex and 2.6 dtex.

4. The nonwoven according to claim 1, the nonwoven having a weight per unit area of between 50 $g/m^2$ and 300 $g/m^2$.

5. The nonwoven according to claim 1, wherein at least some of the framework fibers are needle-punched and/or bonded by a binder.

6. The nonwoven according to claim 1, wherein the embossed grooves are discontinuous.

7. The nonwoven according to claim 1, wherein the nonwoven is in a form of a single-layer structure.

8. The nonwoven according to claim 1, wherein the mesh pattern comprises a diamond pattern, honeycomb pattern, fish scale pattern, waffle pattern, linen pattern, and/or butterfly pattern.

9. The nonwoven according to claim 1, the nonwoven having an MD/CD ratio of a maximum tensile force of more than 0.65.

10. A method for producing the nonwoven according to claim 1, comprising the following method steps:

providing a fibrous web comprising staple fibers and the thermoplastic material;

consolidating the fibrous web by needle-punching, binding, and/or applying heat;

thermally embossing the mesh pattern while at least in part fusing the thermoplastic material, wherein the mesh pattern:

has the plurality of intersecting embossed grooves, between which the plurality of embossed elevations are arranged, the equivalent diameter of the embossed elevations is smaller than 50% of the fiber length of the framework fibers;

the ratio of the width of the embossed grooves to the thickness of the nonwoven in the region of the embossed elevations is less than or equal to 4/5.

11. The method according to claim 10, wherein the consolidation comprises needle-punching and optionally binding and/or applying heat.

12. A product comprising the nonwoven according to claim 1, wherein the product is a wipe for households and/or commercial sector or is a wiping material in a mop.

13. The nonwoven according to claim 1, wherein the at least in part fused thermoplastic material comprises at least in part fused thermoplastic binding fibers.

14. The method according to claim 10, wherein the thermoplastic material comprises thermoplastic binding fibers.

15. The method according to claim 11, wherein applying heat comprises applying heat using a calender or an oven.

16. The nonwoven according to claim 1, wherein the at least in part fused thermoplastic material is present in an amount from 15 wt. % to 25 wt. %, based on total weight of the nonwoven.

* * * * *